United States Patent [19]

Burns

[11] 4,231,734

[45] Nov. 4, 1980

[54] TORCH IGNITER

[76] Inventor: Richard W. Burns, 28 Metacomet Rd., Plainville, Conn. 06062

[21] Appl. No.: 793,517

[22] Filed: May 4, 1977

[51] Int. Cl.[3] ..... F23Q 1/02

[52] U.S. Cl. ..... 431/274; 431/276

[58] Field of Search ..... 431/273, 274, 276, 277

[56] References Cited

U.S. PATENT DOCUMENTS

| | | | |
|---|---|---|---|
| 1,043,190 | 11/1912 | Bachus | 431/276 |
| 1,093,217 | 4/1914 | Valliant | 431/274 |
| 3,154,936 | 11/1964 | Primich et al. | 431/276 |

FOREIGN PATENT DOCUMENTS

| | | | |
|---|---|---|---|
| 256521 | 4/1912 | Fed. Rep. of Germany | 431/273 |
| 428318 | 8/1911 | France | 431/277 |

*Primary Examiner*—Carroll B. Dority, Jr.

[57] ABSTRACT

A torch igniter for attachment to a torch nozzle having a nozzle tip through which a fuel is passed includes an igniter attachment on which a flint and abrading wheel is mounted. The flint is biased against the rim of the abrading wheel at a location thereon generally facing the nozzle tip so that rotation of the wheel generates sparks which are projected in front of the nozzle tip to ignite the fuel passing therefrom. A small electric or pneumatic motor may be connected to the flint wheel to rotate the wheel upon energization of the motor. Compressed gas fed to the torch nozzle may be utilized to drive the pneumatic motor; electric batteries are provided in the case of an electric motor. The igniter attachment is fixedly positioned rearwardly of the nozzle tip and laterally offset therefrom so that the attachment and motor are not adversely affected by the flame.

14 Claims, 6 Drawing Figures

TORCH IGNITER

BACKGROUND OF THE INVENTION

The present invention is concerned with a torch igniter of the type employed to generate sparks used to ignite a compressed gas torch. Such devices are of course old and well known in the art. Abrasive spark igniters are employed to ignite any type of compressed gas torch which, broadly speaking, includes welding and cutting torches such as oxy-acetylene torches, simple propane or other gas fuel torches commonly employed for brazing, paint removal, etc., and even gas fuel fired lanterns, stoves and the like. Such torches have in common a source of pressurized fuel, more specifically a compressed gas or vaporized liquid fuel, which is fed either alone or with air or oxygen through a nozzle, at the tip of which the fuel is ignited to form the desired flame. Such ignition is normally done manually by spark generating means such as an abrading wheel or plate mounted for abrading movement against a flint.

Manually operated spark ignition devices not mounted on the torch have some drawbacks. They have a tendency to become misplaced and it is often inconvenient for the worker to have to free one hand to retrieve the sparker and then manipulate it in front of the nozzle tip to ignite or reignite the flame.

The prior art has provided torch igniters or lighters which are mounted on the torch nozzle and this overcomes at least the tendency for such lighters to be mislaid with attendant inconvenience and loss of time. For example, U.S. Pat. No. 2,826,904 discloses a torch lighter pivotally mounted to the nozzle and carrying a sparking wheel at the outer end of its pivot arm so that the arm may be pivoted to position the sparking wheel in front of the nozzle tip. The wheel is then manually thumb operated to generate the spark and swung back to a position away from the flame emanating from the torch nozzle. U.S. Pat. No. 3,275,060 shows an igniter assembly similar in concept in that it also provides the sparking wheel at the end of a pivotably mounted arm so that it may be pivoted into position to ignite the gas and then pivoted out of the way of the flame.

U.S. Pat. No. 3,743,472 shows a spark igniter device for a gas mantle burner which is also pivotable into and out of a flame ignition position.

While such devices maintain the sparking device attached to the nozzle, they nonetheless require a certain amount of manipulation to swing the pivoting arm into and out of position each time it is desired to ignite or reignite the flame, and further require manual thumb operation of the sparking wheel. The devices are also rather large and cumbersome considering that they are carried on the nozzle itself.

It is an object of the present invention to provide a novel torch igniter attachment which is of simple construction, capable of being mounted on a torch nozzle in a single operative position in which it serves to ignite a flame from the torch tip and remains in that position while not interfering with the flame or being in a position to be damaged by the flame.

It is another object of the present invention to provide a novel torch igniter attachment which is motor driven so that sparks may be generated without necessity of manually thumbing the sparking wheel.

It is yet another object of the invention to provide a simple, relatively inexpensive novel torch igniter to be mounted on a torch nozzle for generating sparks to ignite a flame at the nozzle tip, and one which is motor operated.

SUMMARY OF THE INVENTION

In accordance with the invention, there is provided a torch igniter for attachment to a torch having a torch nozzle including a nozzle tip through which a fuel is passed for ignition. The torch igniter includes an igniter attachment having a mounting base which provides locking means to engage the attachment upon the torch nozzle adjacent the nozzle tip, a motor mount, and a support housing. A wheel support is carried on the support housing.

Spark generating means including a flint and wheel are carried by the igniter attachment, the wheel having a hub and an abrading rim and being mounted on the wheel mount for rotation of the wheet about its hub. The flint is carried by the attachment and has one end in contact with the abrading rim of the wheel. Motor means are supported on the motor mount and includes a shaft connected to the wheel for rotation of the wheel upon energization of the motor means. An energy source is connected to the motor by connector means including a switch which is manually operable to selectively energize the motor to rotate the wheel against the flint whereby sparks are generated by the rotation to ignite fuel passing through the nozzle tip.

Certain objects of the invention are attained when the motor means is a d.c. electric motor, the energy source is one or more electric batteries, and the connector means comprises electrically conductive leads connecting the batteries, the switch and the electric motor in an electric circuit. Alternatively, the motor means may be a pneumatic motor, the energy source a source of compressed gas and the connector means a conduit connecting the source of compressed gas in flow communication to the motor, the switch comprising in this case a valve disposed in the conduit and operable to selectively block or permit flow of gas through the conduit. The source of compressed gas may also be the source of fuel projected through the nozzle tip. The term "gas" as used herein includes air and oxygen.

Certain objects of the invention are attained by the provision of a torch igniter attachment for attachment to a torch nozzle, or by such an igniter in combination with a torch nozzle, the igniter attachment including a mounting base having locking means, a support housing having one end affixed to the mounting base, and an outer end spaced therefrom. A wheel support is carried on the other end of the housing. A torch nozzle has a base end adapted to be connected to a source of fuel, and an opposite and longitudinally extending nozzle end which terminates in a nozzle tip having a discharge orifice through which a fuel is passed for ignition. The locking means engage the torch nozzle adjacent the nozzle tip to fixedly support the igniter attachment on the nozzle with the wheel support disposed adjacent to and rearwardly of the nozzle tip and laterally offset from the longitudinal axis of the nozzle end. Spark generating means including a flint and a wheel are included, the wheel having a hub and an abrading rim and being mounted with the hub on the wheel support for rotation of the wheel thereon in at least a selected direction of rotation. The flint is carried in the housing and has one end projecting outwardly thereof and contacting the rim of the wheel at a contact location thereon such that a line tangent to the rim at the contact location intersects the longitudinal axis of the nozzle end adjacent to and forwardly of the nozzle tip. Therefore, rotation of the wheel in the direction such that the rim is moving towards the nozzle tip at the contact location projects sparks generated by such rotation forwardly of and adjacent to the nozzle tip for the ignition of the fuel passing therethrough.

In accordance with certain aspects of the invention, the flint is slideably carried in the housing and resilient biasing means bias the flint into contact with the rim of the wheel, and the support housing may comprise first and second chambers joined to each other at their respective one ends to define a generally L-shaped configuration of the housing. The resilient biasing means being disposed within the second chamber and including a pivotably mounted pressure plate having a first tab in contact with the resilient biasing means and a second tab lying in a plane which intersects the plane of the first tab and which contacts the flint, whereby the resilient biasing means biases the pressure plate for pivoting movement against the flint and the pressure plate urges the flint into contact with the wheel.

DESCRIPTION OF THE PREFERRED EMBODIMENTS

Figure 1:
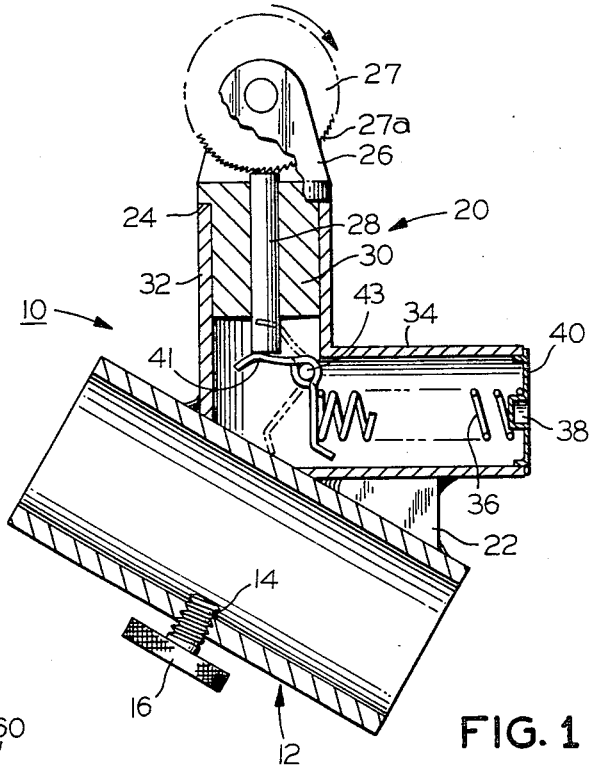
FIG. 1 is a section side view in elevation of one embodiment of a torch igniter in accordance with the present invention.

Referring now to FIG. 1 a torch igniter attachment is generally indicated at 10 and includes a tubular mounting base 12 having a threaded opening 14 formed in the wall thereof to receive a locking screw 16 therein. Tubular mounting base 12 is open at either end to permit it to be slipped over a torch nozzle 18 (FIG. 2) and be releasably engaged therewith by rotating locking screw 16 by means of its knurled head portion to advance its shaft portion within the interior of base 12 against nozzle 18 to securely but releasably hold mounting base 12 thereto. Torch 18 has a longitudinally extending nozzle end 19 terminating in a nozzle tip 42 with a discharge orifice, and an opposite base end 21.

Referring to FIG. 1, an L-shaped support housing generally indicated at 20 is secured to the mounting base in fixed orientation by being welded or brazed thereto. A supporting web 22 helps to support housing 20 on base 12. Housing 20 has a first chamber 32 and a second chamber 34. First chamber 32 of housing 20 has an outer end 24 which has a wheel mount 26 supported thereon. Outer end 24 is open to permit a flint 28 of generally cylindrical shape to project therethrough. In the embodiment illustrated, wheel mount 26 includes a base portion 30 which fits within first chamber 32 of housing 20 and closes the outer end thereof except for a passage (unnumbered) formed in base portion 30 which receives flint 28 therein for sliding movement therethrough. The passage in base portion 30 leaves an unobstructed opening in outer end 24 through which flint 28 projects. Wheel mount 26 comprises a pair of spaced apart supports journaled to receive for rotation therein an abrading wheel 27 having an abrading peripheral rim **27*a*. Wheel 27 is adapted to be rotated, either manually or by means described hereinbelow, in the direction shown by the arrow in FIG. 1 so that abrading rim 27*a* strikes sparks from the end of flint 28 which sparks are projected leftwardly as viewed in FIG. 1**.

Figure 2:
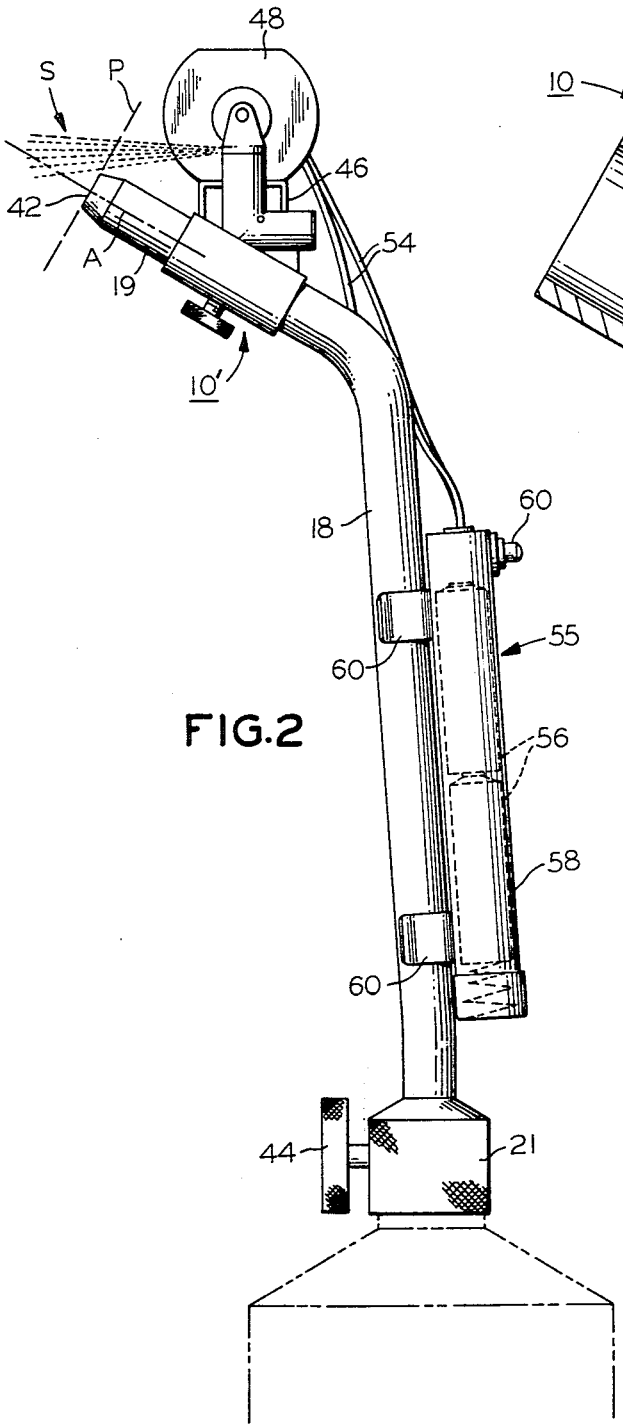
FIG. 2 is a side view in elevation of the torch igniter of FIG. 1 equipped with an electric motor and showing the lighter mounted on a torch nozzle, FIG. 2 being drawn to a scale smaller than that of FIG. 1.
Figure 1A:
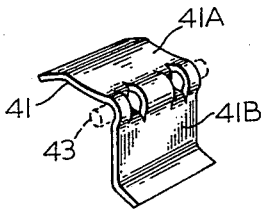
FIG. 1A is a perspective view of a component of the igniter of FIG. 1, with one part shown in dotted outline.

Within second chamber 34 there is mounted a resilient expansion means comprising a coil spring 36, one end of which is seated upon a boss 38 formed on an end closure 40 of second chamber 34. A pressure plate 41 is pivotably mounted upon a hinge pin 43, the opposite ends of which are mounted in the wall of housing 20, as seen in FIG. 2. As best seen in FIG. 1A, pressure plate 42 comprises a strip of metal bent to approximately a right angle to define a pair of tabs 41A, 41B disposed transversely to each other and having a generally L-shaped profile. A portion of plate 42 is punched out at the junction of tabs 41A, 41B to form a sleeve within which hinge pin 43, shown in dotted outline in FIG. 1A, is received. The free end of coil spring 36 bears against tab 41B of pressure plate 42. Tab 41A of pressure plate 42, which lies in a plane intersecting the plane in which the tab 41A lies, bears upon the inside end of flint 28, i.e., the end opposite that which bears on wheel 27. Coil spring 36, by virtue of its tendency to expand, thus biases pressure plate 42 into clock-wise (as viewed in FIG. 1) pivoting movement about hinge pin 43 and the resulting pressure exerted by tab 41A of pressure plate 42 biases flint 28 into engagement with peripheral rim **27*a* of wheel 27. The ends of tabs 41A, 41B are appropriately turned to provide secure seating of one end of coil spring 36 on tab 41B, and to permit tab 41A to smoothly follow flint 28 as it biases it into engagement with wheel 27**.

As flint 28 wears down in use, the expansion of coil spring 36 pivots pressure plate 41 towards the position indicated in dotted outline in FIG. 1 to maintain flint 28 biased into engagement with wheel 27 at least until flint 28 is worn sufficiently short that it must be replaced.

As shown in FIG. 2, torch igniter 10' is positioned at a point along nozzle 18 at which the sparks generated by rotation of wheel 27 project in front of nozzle tip 42 to ignite the combustible gas emerging therefrom. For any given nozzle, mounting base 12 may be moved along nozzle end 19 to a desired position therealong at which the sparks project in front of nozzle tip 42 to ignite the flame, yet the igniter is sufficiently rearward of nozzle tip 42 so as not to be heated unduly by the flame. This may be better appreciated by considering, in FIG. 2, the imaginary plane P which is indicated as located at the end of the nozzle tip 42 having the discharge orifice and drawn perpendicularly to longitudinal axis A of nozzle end 19 and its discharge orifice. It will be noted that igniter attachment 10, and more particularly, substantially the entirety of wheel support 26 and flint wheel 27 thereon, are positioned rearwardly of plane P, i.e., they are positioned rearwardly of nozzle tip 42. As used herein and in the claims, "rearwardly" of the nozzle tip means rearwardly i.e., in the direction moving along the nozzle end from the tip towards the base, of an imaginary plane disposed perpendicularly to the longitudinal axis of the nozzle end and coinciding with the outermost end of the nozzle tip. Sparks S generated by rotation of wheel 27 in the selected direction indicated by the arrow in FIG. 2 project to a point adjacent to and forwardly of nozzle tip 42 to ignite the fuel passing therethrough. The point at which flint 28 contacts rim 27*a* of wheel 27 (see FIG. 1) is seen to be positioned rearwardly of nozzle tip 42 and laterally offset from longitudinal axis A of nozzle end 19 at a point along rim 27*a* which generally faces nozzle tip 42 so that rotation of wheel 27 in the direction shown projects sparks S in the desired direction.

Referring to FIGS. 1 and 2 jointly, it will be observed that sparks S are projected along a line extending tangentially from the point on rim 27*a* where flint 28 contacts wheel 24. This line, and the sparks S which project generally along it, can be extended to intersect an extended portion of longitudinal axis A adjacent to and forwardly of nozzle 42. It will be appreciated that as used herein "rearwardly" of nozzle tip 42 means in a direction away therefrom along nozzle 18 towards the base end 21 thereof, and "forwardly" of nozzle tip 42 means in the opposite direction along the extended portion of longitudinal axis A. The preferred L-shape of housing 20 brings wheel 27 closer to longitudinal axis A than would otherwise be possible to shorten the path of travel of sparks S to an effective position in front of and adjacent to nozzle tip 42. As shown in FIG. 1, support housing 20 is disposed, at least in that portion thereof (chamber 32) which carries flint 28, to extend at an acute angle to longitudinal axis A of nozzle end 19. Thus, igniter attachments 10, 10' and 10'' and the associated motor, if any, are positioned so that sparks generated by rotation of the wheel are projected in sufficient density forward of the nozzle tip and yet the igniter and/or motor is not so close to the flame as to be adversely affected by the heat. In this manner, the igniter attachment may be fixedly mounted to the nozzle tip. That is, it need not be removed or swung out of the way after each ignition of the flame but remains in place on nozzle 18. Advantageously, the torch igniter is made releasable so it can be removed from one nozzle and fixedly mounted on another as desired.

Figure 3:
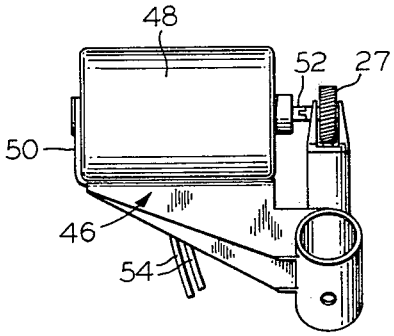
FIG. 3 is a partial end view in elevation of the embodiment of FIG. 2.

FIG. 2 shows a torch igniter 10' mounted on a torch nozzle 18 which includes an adjusting knob 44 to regulate the flow of gas from a compressed gas cylinder, shown in dot-dash outline in FIG. 2, to which nozzle 18 is threadably attached. The torch igniter 18' shown in FIG. 2 is identical to the basic torch igniter 10 in FIG. 1, but further includes a motor mount 46 (best seen in FIG. 3) on which a small electric motor 48 is mounted. As best seen in FIG. 3 (and also FIG. 4) motor mount 46 includes a pair of spaced apart flanges 46*a* and 46*b* connected by an intermediate web section (unnumbered) one end of which extends beyond flanges 46*a* and 46*b* and is turned up to comprise a fastening tab 50. Motor 48 is securely held to motor mount 46 by suitable means including clip 50 and electric motor 48 is connected to the hub of wheel 27 by a shaft 52. Shaft 52 is driven by motor 48 upon energerization thereof and rotates wheel 27 against the end of flint 28 to generate sparks therefrom. Shaft 52 is disengageable to permit changing of wheel 27.

As seen in FIG. 2, electrical leads 54 connect motor 48 to an energy source 55, comprising in this case electric batteries 56, shown in dotted outline in FIG. 2, contained within a battery case 58. Electric leads 54 connect motor 48 in an electric circuit with batteries 56 and a switch operated by button 60. Manually operated button switch 60 may be pushed to close the electric circuit and supply electric current from batteries 56 to motor 48 for operation thereof. Upon release of button 60 the circuit is opened and operation of the motor ceases. Mounting clips 60 hold battery case 58 to nozzle 18 at a position thereon remote from nozzle end 19.

Thus in operation, when it is desired to ignite a flame from torch tip 42, adjusting knob 42 is turned to allow gas flow from the cylinder and button 60 is depressed to generate sparks to ignite the flame. Should the flame extinguish during operation, as frequently occurs, the operator need simply depress button switch 60 to generate sparks to reignite the flame.

The contact point of flint 28 with wheel 27 lies in a common plane with the longitudinal axis of nozzle end 19, and is offset therefrom but sufficiently close thereto so that the sparks generated pass in front of nozzle tip 42 in sufficient concentration to readily ignite the combustible gas exiting therefrom, as schematically indicated by the dotted line representation of sparks S in FIG. 2.

By providing the spark generating contact between the flint and the wheel closely adjacent to mounting base 12 the trajectory of the generated sparks S can be directed in front of nozzle tip 42 while yet positioning the torch igniter sufficiently rearwardly of tip 42 so that heat from the flame generated at nozzle tip 42 does not adversely affect the torch igniter motor, etc. The batteries are positioned sufficiently far from the flame to be unaffected by the heat.

Any suitable electric motor may be employed. One which has been satisfactorily used is a three volt, 5,000 rpm batter powered DC electric motor, sold under the trademark ARCHER by Radio Shack, a Tandy Corp. Company, under catalog No. 273-211. This motor is about 1¼ inches long and has a maximum diameter of about one inch. Battery operation of the wheel provides for sustained rotation even with flint 28 biased with high bearing pressure against wheel 27. This insures adequate spark production as frequently as required to ignite or reignite the flame.

Figure 5:
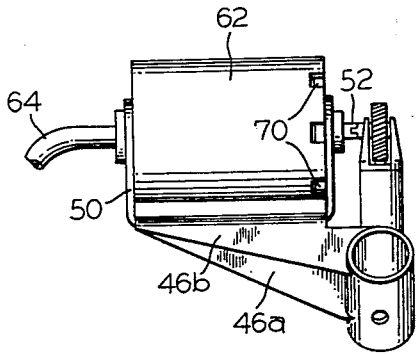
FIG. 5 is a partial end view in elevation of the embodiment of FIG. 4.
Figure 4:
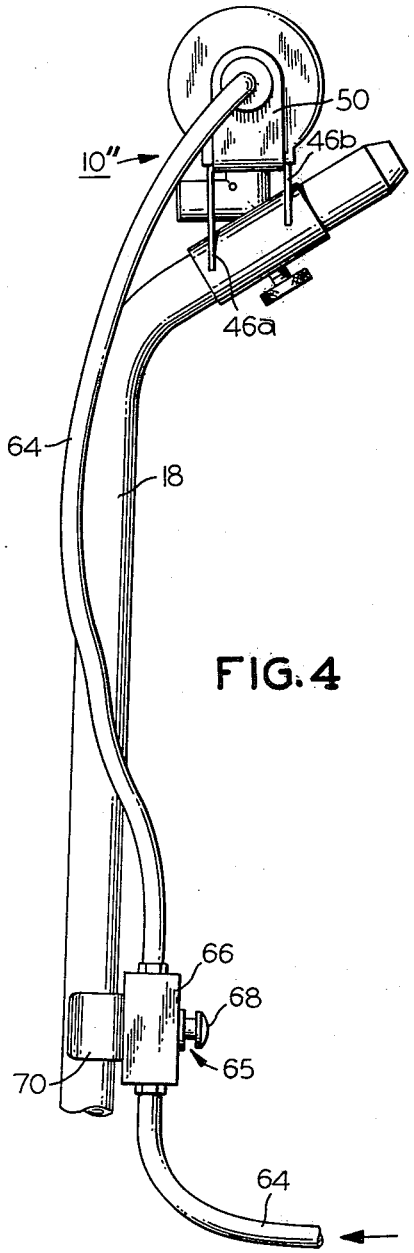
FIG. 4 is a view corresponding to that of FIG. 2 of a pneumatic motorized embodiment of the invention.

Referring now to FIGS. 4 and 5, there is shown another embodiment of the invention substantially identical in every respect to the embodiment described with respect to FIGS. 2 and 3, but comprising an igniter 10'' in which a pneumatic motor 62 is provided in lieu of the electric motor 48 of the FIGS. 2 and 3 embodiment. Pneumatic motor 62 is connected by conduit 64 to any suitable supply of compressed gas. This may conveniently be the compressed gas fuel to be burned by the torch or may be compressed air or oxygen, which is often used with a fuel gas in welding. As is well known, a dual connection adapter may be provided on the compressed gas fuel cylinder so that one connection feeds gas to the torch nozzle and the other connection feeds gas to conduit 64, optionally through a pressure reduction valve. Thus, although not shown in FIG. 4, conduit 64 is conveniently connected through a suitable coupling to the gas cylinder to which torch nozzle 18 is connected. Switch means 65 comprises a control valve 66 connected in conduit 64 and operable by a push button 68. When push button 68 is depressed, valve 66 is moved to an open position and permits gas to flow through conduit 64 in the direction indicated by the arrow in FIG. 4. When push button 68 is released, valve 66 returns to its closed position to block flow of gas through conduit 64. Switch means 65 includes a mounting clip 70 to enable it to be conveniently secured to nozzle 18 or elsewhere.

When gas is flowing through conduit 64 by reason of button 68 being manually held in the depressed position, the gas flows into and through motor 62 to turn shaft 62 and thereby to rotate wheel 27. The associated gas emerges from motor 62 through vent openings 70 provided therein (FIG. 5) which are baffled to direct exhaust gas away from the sparks. Alternatively, motor 62 may be constructed so that exhausted gas from it is vented from the end of motor 62 which is opposite the end from which shaft 52 protrudes. Existing pneumatic motors of the type illustrated may be modified by attaching a housing over motor 62 to insure that any exhausted combustible gases are projected away from sparks generated by the device. When compressed air or oxygen is used to drive the motor, such precautions may not be needed.

Pneumatic motor 62 may be any well known pneumatic motor such as are employed in dental drills, metal marking styluses and the like. Such pneumatic motors have dimensions about the same as or slightly smaller than those described above with relation to the electric motor. Typically, gas pressure in compressed gas cylinders used for torch fuel is available at pressures of, usually, 50 to 3,000 psi, and suitable pressure reduction fittings may be employed as necessary.

While the invention has been described in detail with respect to specific embodiments thereof, it will be apparent that numerous changes and modifications may be made thereto which are nonetheless within the spirit and scope of the appended claims.

Having thus described the invention, what is claimed is:

1. A torch igniter for attachment to a torch having a torch nozzle including a nozzle tip through which a fuel is passed for ignition comprising:

(a) an igniter attachment including a mounting base providing locking means to engage said attachment upon a torch nozzle adjacent the nozzle tip thereof, a motor mount, and a support housing having a wheel support carried thereon;

(b) spark generating means including a flint and wheel carried by said igniter attachment, said wheel having a hub and an abrading rim and being mounted on said wheel support for rotation of said wheel about its hub, said flint being carried by said attachment and having one end in contact with said abrading rim;

(c) motor means supported on said motor mount and including a shaft connected to said wheel for rotation thereof upon energization of said motor means; and (d) an energy source connected to said motor by connector means including a switch which is manually operable to selectively energize said motor to rotate said wheel against said flint whereby sparks are generated by such rotation to ignite fuel passing through said nozzle tip.

2. The assembly of claim 1 wherein said motor means is a d.c. electric motor, said energy source is one or more electric batteries and said connector means comprises electrically conductive leads connecting said one or more batteries, said switch and said electric motor in an electric circuit.

3. The assembly of claim 2 wherein said one or more batteries are contained within a battery case and said battery case includes mounting means adapted to mount said case to said torch nozzle.

4. The assembly of claim 1 wherein said motor means is a pneumatic motor, said energy source is a source of compressed gas and said connector means comprises a conduit connecting said source of compressed gas in flow communication to said motor, said switch comprising a valve disposed in said conduit and operable to selectively block or permit flow of gas through said conduit.

5. The assembly of claim 4 wherein said source of compressed gas is also the source of fuel projected through said nozzle tip.

6. The assembly of claim 4 wherein said conduit is connected at one end to said pneumatic motor and has at its other end a connector adapted to connect said conduit to a source of compressed gas.

7. The assembly of claim 1 in combination with a fuel nozzle adapted to be connected to a source of fuel comprising a compressed gas for passage of said gas through said nozzle.

8. The assembly of claim 7 further including a pressure reduction valve connected in said conduit.

9. The combination of a torch igniter and a torch nozzle comprising:

(a) an igniter attachment including a mounting base having locking means, a support housing having one end affixed to said mounting base, and an other end spaced therefrom, said support housing comprising first and second chambers joined to each other at their respective one ends to define a generally L-shaped configuration of said housing, said other end of said housing being defined by the other end of said first chamber;

(b) a wheel support carrier on said other end of said housing;

(c) a torch nozzle having a base end adapted to be connected to a source of fuel, and an opposite and longitudinally extending nozzle end which terminates in a nozzle tip through which a fuel is passed for ignition, said locking means engaging said torch nozzle adjacent said nozzle tip to fixedly support said igniter attachment on said nozzle with said wheel support disposed adjacent to and rearwardly of said nozzle tip and laterally offset from the longitudinal axis of said nozzle end;

(d) spark generating means including a flint, a wheel, and resilient biasing means, said wheel having a hub and an abrading rim and being mounted with said hub on said wheel support for rotation of said wheel thereon in at least a selected direction of rotation, said flint being slideably carried in said housing and having one end projecting outwardly thereof and biased into contact with said abrading rim of said wheel at a contact location thereon such that a line tangent to said rim at said contact location intersects said longitudinal axis of said nozzle end adjacent to and forwardly of said nozzle tip, said resilient biasing means being disposed within said second chamber and including a pivotably mounted pressure plate having a first tab in contact with said resilient biasing means and a second tab lying in a plane which intersects the plane of the first tab and which contacts said flint whereby said resilient biasing means biases said pressure plate for pivoting movement against said flint and said pressure plate urges said flint into said contact with said wheel; whereby rotation of said wheel in the direction such that said rim is moving towards said nozzle tip at said contact location projects sparks generated by such rotation forwardly of and adjacent to said nozzle tip for said ignition of said fuel passing therethrough.

10. The combination of claim 9 further including a motor mount affixed to said igniter, a motor means mounted on said motor mount, an energy source connected to said motor, a shaft extending transversely to the plane of rotation of said wheel and connected at one end to said motor means for rotation of said shaft by said motor means and connected at its other end to said wheel hub, whereby rotation of said shaft by said motor rotates said wheel against said flint, and further including means connecting said motor to said energy source to selectively energize said motor to rotate said wheel.

11. The combination of claim 10 wherein said motor means is an electric motor and said energy source comprises battery means connected in an electric circuit to said motor by electrically conductive leads, said circuit including a normally open switch which is closeable to selectively close said circuit to operate said motor.

12. The combination of claim 10 wherein said motor means is a pneumatic motor and said energy source comprises a source of compressed gas connected by a conduit to said motor, and a normally closed control valve in said conduit which is openable to selectively admit compressed gas therethrough to operate said motor.

13. In combination:

a. a torch noxxle having a base end adapted to be connected to a source of fuel and an opposite end comprising a longitudinally extending nozzle portion terminating in a nozzle tip with a gas discharge orifice therein through which a fuel is passed for ignition, said nozzle portion having a longitudinal axis extending through said gas discharge orifice; and b. an igniter attachment mounted on said torch nozzle and including:

1. a mounting base slidable on said torch nozzle and having locking means engaging said torch nozzle at a point adjacent said nozzle tip to fixedly support said igniter attachment on said nozzle;
2. a support having one end affixed to said mounting base and its other end spaced therefrom with a longitudinal axis defined by an imaginary line between said ends, said support being fixedly oriented relative to said mounting base;
3. a wheel support on said other end of said support;
4. spark generating means including a flint and a wheel, said wheel having a hub and an abrading rim and being mounted with said hub on said wheel support for rotation of said wheel thereon in a selected direction of rotation, said flint being carried on said support and having one end thereof contacting said rim of said wheel at a contact location thereon;

said igniter attachment being locked on said nozzle at a point spaced from said discharge orifice of said tip, the entirety of said igniter attachment, wheel support and spark generating means being disposed on said nozzle at a point spaced rearwardly of an imaginary plane located at the end of said nozzle tip having said discharge orifice and drawn perpendicular to the longitudinal axis of said nozzle portion, said flint and the axis of rotation of said wheel being spaced towards said nozzle tip from the juncture of the axis of said support with said base, said spark generating means being disposed so that an imaginary line tangent to said rim at said contact location may be extended to intersect an extension of the longitudinal axis of said nozzle tip at a point spaced outwardly from said discharge orifice, whereby rotation of said wheel projects sparks outwardly of and adjacent to said discharge orifice of said nozzle tip for ignition of fuel passing therethrough.

14. The combination of claim 13 wherein said axis of said support extends at an acute angle to said longitudinal axis of said nozzle end towards said tip.

* * * * *